United States Patent [19]

Walton et al.

[11] 4,039,995

[45] Aug. 2, 1977

[54] ELECTRIC HEATING ELEMENTS

[75] Inventors: Frank T. Walton, Oakmont; Walter J. Dzaack, Glenshaw, both of Pa.

[73] Assignee: Emerson Electric Co., St. Louis, Mo.

[21] Appl. No.: 682,955

[22] Filed: May 4, 1976

[51] Int. Cl.[2] ..... H01C 7/22

[52] U.S. Cl. ..... 338/295; 29/611; 29/621; 219/548; 338/274; 338/299; 338/325

[58] Field of Search ..... 338/238, 239, 243, 260, 338/261, 267, 270, 273, 274, 295, 325; 29/610, 611, 621; 219/544, 546, 548, 523

[56] References Cited

U.S. PATENT DOCUMENTS

| | | | |
|---|---|---|---|
| 3,217,279 | 11/1965 | Boggs | 338/274 X |
| 3,307,135 | 2/1967 | Simmons | 338/239 |

*Primary Examiner*—C. L. Albritton

*Attorney, Agent, or Firm*—Michael Williams

[57] ABSTRACT

An electric resistance heating element, comprising at least two elongated dielectric bodies, each having a plurality of openings extending longitudinally thereon in radially displaced, parallel relation. Three metal pins fit into openings in the dielectric bodies and at least certain maintain the latter in longitudinally aligned relation. A resistance wire is wound on each of the bodies, each wire having longitudinally spaced terminals. One of the terminals of each resistance wire is electrically connected to one pin; the opposite terminal of one resistance wire is electrically connected to a second pin; and the opposite terminal of the other resistance wire is electrically connected to the third pin, whereby the one pin serves as a common electrical connection for both resistance wires, and the second and third pins serve as separate electrical connections to the respective resistance wires, whereby separate electrical circuits may be established within the heating element.

Our invention also makes it possible to provide three phase electrical connections between resistance wires separately wound on at least three dielectric cores. This is accomplished by properly orienting the cores so that the opposite terminals on each are aligned for electrical engagement with three terminal pins which pass through longitudinally aligned openings in the cores.

12 Claims, 10 Drawing Figures

A
B
C
C
B
A

ELECTRIC HEATING ELEMENTS

BACKGROUND AND SUMMARY

The present invention relates to new and useful improvements in electric resistance heating elements, particularly of the cartridge type. The following U.S. patents afford an understanding of the prior art as presently known by applicants:

| | | |
|---|---|---|
| 2 831 951 | Desloge | Apr 22, 1958 |
| 2 977 453 | Wells | Mar 28, 1961 |
| 3 134 956 | Boggs | May 26, 1964 |
| 3 217 279 | Boggs | Nov 9, 1965 |
| 3 307 135 | Simmons | Feb 28, 1967 |

The above noted patents, with the exception of Wells, disclose development of cartridge heater construction wherein ceramic cores, upon which resistance wires have been wound, are disposed in "skewered" relation on a pair of terminal pins or rods. Boggs U.S. Pat. No. 3,217,279 discloses a development wherein two or more coils may be placed in an electric circuit whereby a part or all of the coils may be energized. Simmons discloses an arrangement wherein two or more coils may be disposed in a series electrical relation.

The foregoing constructions do not possess the ability to effect other circuit relationships, such as utilization of one voltage source to energize one coil, and a different voltage source to energize another coil. For example, through use of our improved construction, one voltage may be 120 volts whereas the other may be 12 volts, or a three-phase connection may be made between coils separately wound on three cores. Other variations will be apparent from the description which follows.

The improvement over the prior art is made possible by providing a plurality of openings in each of at least two ceramic cores, the openings extending longitudinally of each core. Three metal pins fit into respective openings in the cores and at least certain of the pins maintain the cores in serially disposed, longitudinally aligned relation. Each core has a resistance wire coiled about its exterior surface, with terminals at opposite ends of the core. One of the terminals of each resistance coil is electrically connected to one pin; the opposite terminal of one resistance coil is electrically connected to a second pin; and the opposite terminal of the other resistance wire is electrically connected to the third pin, whereby the said one pin serves as a common electrical connection for both resistance coils, and the second and third pins serve as separate electrical connections to respective resistance coils. Thus, for example, the common pin may be connected to one terminal of a 120 volt source and to one terminal of a 12 volt source. The other terminal of the 120 volt source may be connected to the second pin and the other terminal of the 12 volt source may be connected to the third pin. By suitable switching arrangement, either one of the resistance coils may be energized. The particular example just mentioned has considerable utility for use as a heating device in a boat or automobile, where a 120 volt source is usually available when the auto is garaged, or the boat docked, but where only a 12 volt source is otherwise available.

DESCRIPTION OF THE DRAWINGS

In the drawings accompanying this specification and forming a part of this application, there are shown, for purpose of illustration, several embodiments which our invention may assume, and in these drawings.

DESCRIPTION OF THE PREFERRED EMBODIMENT

Figure 1:
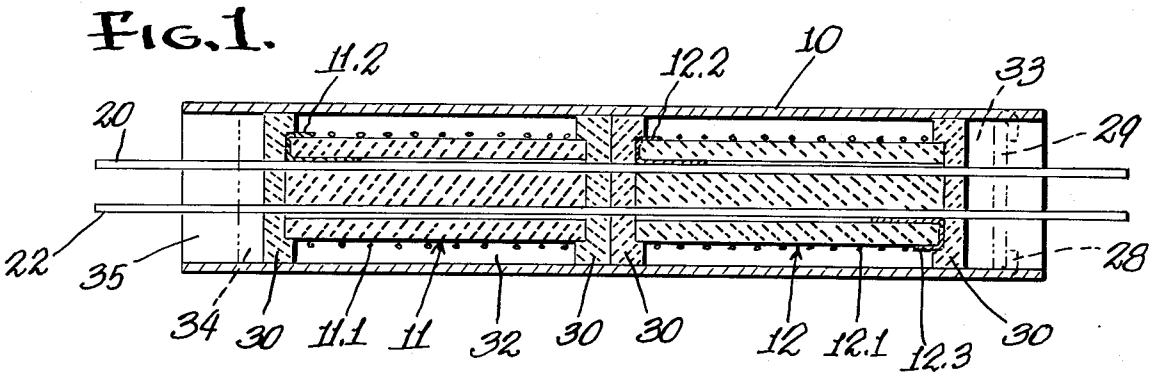
FIG. 1 is a longitudinal section through a preferred embodiment of our invention, showing disposition of parts prior to final working of the cartridge heater.

FIG. 1 is a longitudinal section which is generally similar to FIG. 1 of Boggs U.S. Pat. No. 3,217,279, and reference is made to the description in that patent for details in the manufacture of this particular type of cartridge heater.

In FIG. 1 of this application, a tubular metal sheath 10 is adapted to house the components of the cartridge heater, the sheath being shown in an intermediate stage of manufacture. FIG. 1 shows two cylindrical ceramic cores 11 and 12 disposed in longitudinally aligned relation within the heater, each core having an outside diameter which is considerably less than the inside diameter of the sheath to provide an annular space which is subsequently filled with powdered refractory material.

The cores 11 and 12 are preferably identical, although it is possible to make one longer or of greater diameter than the other, within the spirit of our invention. The cores have at least three openings extending longitudinally therethrough in similarly radially spaced, parallel relation. In the disclosed embodiment, four lontudinal openings are shown, these openings being designated 14, 15, 16 and 17, with centers on a circle the center of which is the center of the cylindrical core. The openings are spaced ninety degrees part, although this spacing may be varied. The embodiment disclosed in FIGS. 1 and 2 makes use of only three longitudinal openings and if only three are formed in each ceramic core, they could be spaced one hundred twenty degrees apart. However, it is preferred to utilize four openings since the cores are then adaptable to further embodiments of our invention.

Each core has a resistance wire wound thereabout, the wire on the core 11 being designated 11.1 and the wire on the core 12 being designated 12.1. Opposite ends of each resistance wire terminate adjacent to opposite ends of a respective core and are either inserted into core openings or, as shown in said Boggs patent, are attached to thin metal members which are inserted into the core openings.

Figure 2:
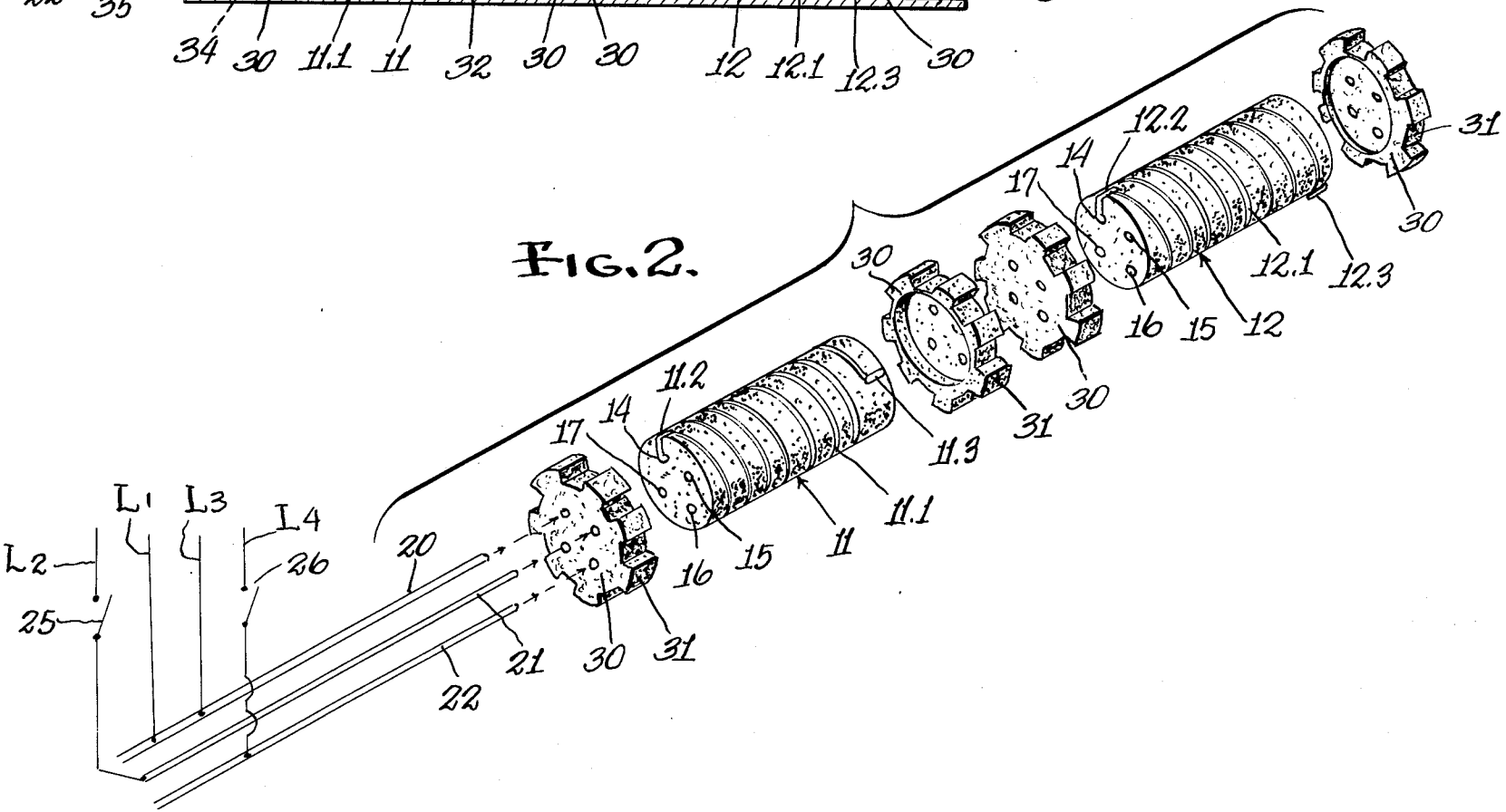
FIG. 2 is a perspective view showing various parts of FIG. 1 in disassembled relation.

As best seen in FIG. 2, one terminal 11.2 of the coil 11.1 is inserted into core opening 14 at one end of the core, and the opposite terminal 11.3 is inserted into core opening 15 at the opposite end of the core. Since the cores 11 and 12 are identical, for purpose of this disclosure it will be assumed that the core openings of core 12 are in the same relation, and longitudinally aligned with the openings in core 11 and therefore are given the same reference numerals. Again referring to FIG. 2, one terminal 12.2 of the coil 12.1 is inserted into opening 14 at one end of the core, and the other terminal 12.3 is inserted into opening 16 at the other end of the core. The precise location of the coil terminals in the manner just described is not of importance, but what is of importance is that on assembly with three elongated metal terminal pins 20, 21 and 22, that is, with the pins inserted within three of the core openings, the terminals 11.2 and 12.2 are electrically connected to the pin 20; the terminal 11.3 is electrically connected to the pin 21; and the terminal 12.3 is electrically connected to the pin 22.

The coils 11.1 and 12.1 may have the same or a different number of turns or may be formed of wire having the same or different resistivity. As shown diagramatically in FIG. 2, the common terminal pin 20 may be connected to one line L1 of a source of predetermined voltage and the terminal pin 21 may be connected to the other line L2 of such source, and a switch 25 may be inserted in one of the lines. Also, the common terminal pin 20 may be connected to one line L3 of a source of the same or different voltage and the terminal pin 22 may be connected to the other line L4 of such source, and a switch 26 may be inserted in one of the lines.

The terminal pins 20, 21 and 22 are preferably of the same length for sake of uniformity and may be long enough to extend outwardly from opposite ends of the sheath, as shown in FIG. 1. As one of the final steps in the production of a cartridge heater, the pins at one end of the sheath (the right hand end in FIG. 2) are trimmed and this sheath end is turned in, as shown in dotted lines at 28, over a metal closure disc 29 which is welded in place to form a hermetic seal.

As seen in FIG. 1, ceramic spacer discs 30 are disposed at opposite ends of the core assembly, and between the cores 11 and 12, the discs being cup-shaped to fit over respective core ends to center the latter. The discs have openings therethrough, corresponding to the openings 14, 15, 16 and 17 to pass the pins 20, 21 and 22. The discs 30 have a toothed periphery, as seen at 31 in FIG. 2, with the outer portions of the teeth slidably fitting the inner wall of the sheath to center the core assembly within the sheath. The teeth of the core provide spaces through which granular refractory material may flow to fill the annular space 32 between the exterior of the cores and the interior wall of the sheath. Commonly, a bushing (not shown) is disposed within one open end of the sheath and the granular refractory is poured into the other end. A bushing is then disposed within the other sheath end, and the sheath is subjected to a swaging operation to transversely reduce the same. The swaging operation crushes the cores 11 and 12 and transforms them and the refractory material within the sheath space to a rocklike homogemous mass.

The closure bushings are then removed and the terminal pins at the right-hand end of the sheath are cropped so that they do not extend beyond the sheath end. The sheath is end-trimmed to a predetermined length and suitable insulating bushing 33 is inserted into the right hand end of the sheath and this end is closed over the metal disc 29. A suitable insulating bushing 34 is inserted within the left hand end of the sheath and the space 35 sealed by a suitable cement.

DESCRIPTION OF FURTHER EMBODIMENTS

Figures 3, 4, 5, 6, 7, 8, 9, 10:
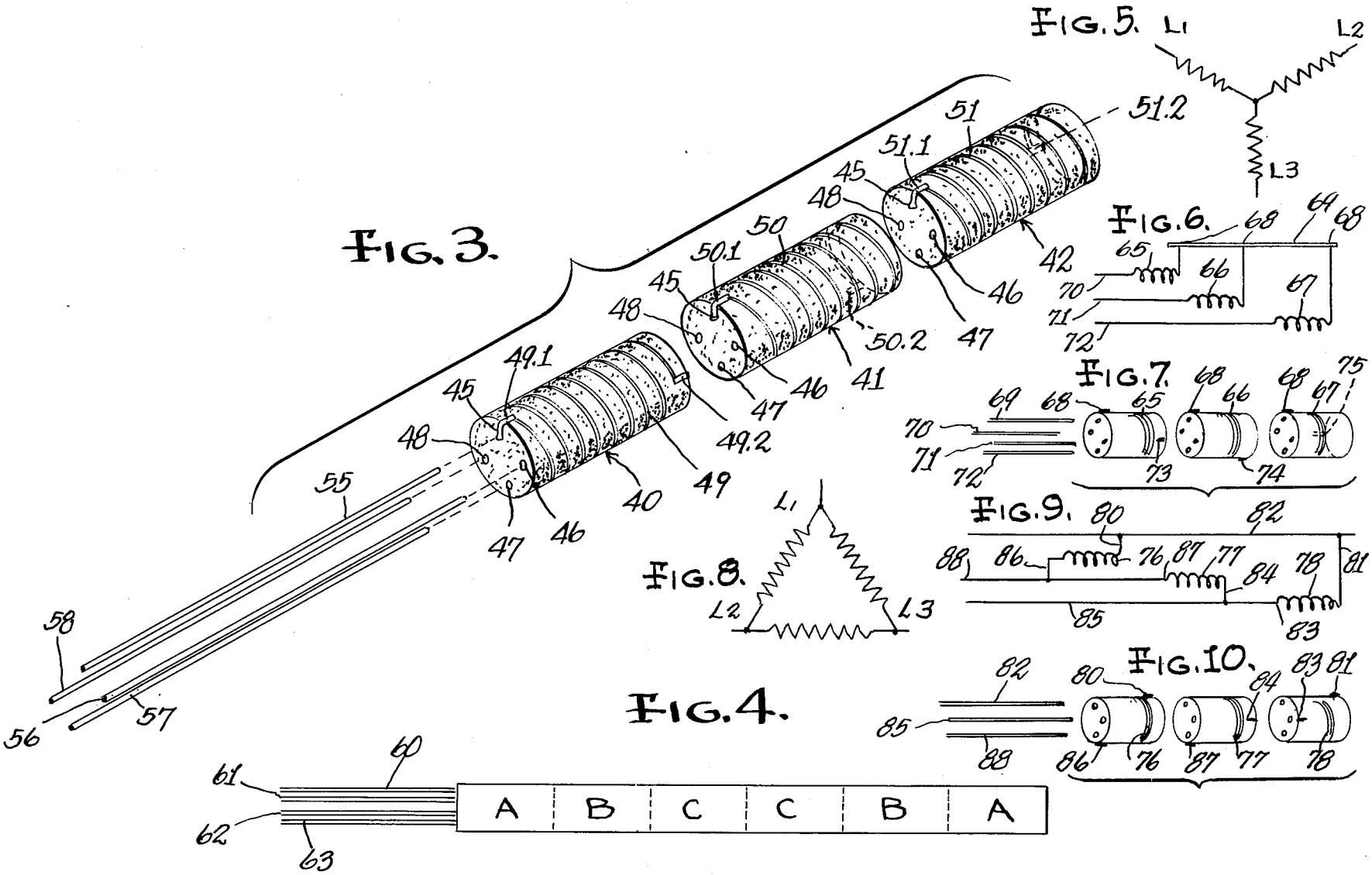
FIG. 3 is a disassembled perspective view of parts showing an extension of the embodiment of the invention disclosed in FIGS. 1 and 2.
FIG. 4 is a diagramatic representation, showing a further extension of the invention.
FIG. 5 is an electrical representation of a Y three-phase circuit.
FIG. 6 is a circuit representation showing how a Y three-phase connection may be made in use of our invention.
FIG. 7 is a represenation of three dielectric cores, oriented so that their terminals are arranged for three-phase Y connection.
FIG. 8 is an electrical representation of a Delta three-phase circuit.
FIG. 9 is a circuit representation showing how a Delta three-phase connection may be made in use of our invention.
FIG. 10 is a representation of three dielectric cores, oriented so that their terminals are arranged for three-phase Delta connection.

FIG. 3 discloses an extension of the embodiment of FIGS. 1 and 2, wherein three ceramic cores 40, 41, 42 are utilized. These cores are like the cores hereinbefore described, and each has four openings 45, 46, 47 and 48, extending therethrough. The core 40 has a resistance wire coil 49 wound thereon with terminals at opposite ends of the core. The terminal 49.1 is inserted within the opening 45 at one end of the core and the terminal 49.2 is inserted within the opening 46 at the other end of the core.

The core 41 has a resistance wire coil 50 wound thereon with terminals at the opposite ends of the core. The terminal 50.1 is inserted within the opening 45 at one end of the core, and the terminal 50.2 is inserted within the opening 47 at the other end of the core. The core 42 has a resistance wire coil 51 wound thereon with terminals at the opposite ends of the core. The terminal 51.1 is inserted within the opening 45 at one end of the core, and the terminal 51.2 is inserted within the opening 48 at the other end of the core.

The spacer discs 30 are omitted from FIG. 3, but will be present in the final assembly. A first terminal pin 55 is inserted in the aligned openings 45 of the cores 40, 41 and 42, and will make electrical engagement with the terminals 49.1, 50.1 and 51.1, to serve as a common terminal pin for all coils. A second terminal pin 56 is inserted within the opening 46 of at least the core 40 to complete an electrical circuit to the coil 49. A third terminal pin 57 is inserted within the aligned openings 47 of at least the cores 40 and 41 to complete an electrical circuit to the coil 50. A fourth terminal pin 58 is inserted through the aligned openings 48 of the cores 40, 41 and 42 to complete and electrical circuit to the coil 51. It will be appreciated that the terminal pin 55 is a common terminal for the coils 49, 50 and 51, and that the terminal pins 56, 57 and 55 and 58 are terminals for the respective coils 49, 50 and 51.

The coils 49, 50 and 51 may be of different windings, or have different resistive values, or the voltages impressed on the terminal pins 55, 56; 55 and 57 and 55 and 58, may be such that the wattages of the coils 49, 50 and 51 are different, such as 100 watts, 200 watts, and 300 watts, in the example disclosed.

FIG. 4, discloses a further extension of the embodiment of our invention wherein various wattages may be provided at selected lengths of the cartridge heater. In this embodiment, six cores, with wire-wound resistors, are utilized. Cores A—A may be of the type designated as 40 in FIG. 3; cores B—B may be of the type designated as 41; and cores C—C may be of the type designated as 42, and it is assumed that the terminals of such cores are arranged as shown in FIG. 3. A common terminal pin 60 will be placed in electrical engagement with one terminal of each of the windings on all cores. A second terminal pin 61 will complete an electrical circuit to the coils of cores A—A; a third terminal pin 62 will complete an electrical circuit to the coils of cores B—B; and a fourth terminal pin 63 will complete an electrical circuit to the coils of cores C—C. Thus, by proper switching, the coils on cores A—A, B—B, and C—C may be separately energized, or all, or various combinations may be energized.

A three-phase connection to three coils separately wound on three ceramic cores may also be made. FIG. 5 depicts a typical three-phase Y connection to terminals L1, L2 and L3, and FIG. 6 discloses the electrical connection of the coils in accordance with our invention. The three coils 65, 66 and 67, as shown in FIGS. 6 and 7, each have one terminal 68 aligned for electrical connection with a terminal pin 69. The pin 69 is not connected to a source of electricity, but merely provides a common connection between the terminals 68 of all three coils. The terminal pins 70, 71 and 72 are each adapted to be connected to a respective one of the three-phase current lines, and are also electrically connected to respective terminals 73, 74 and 75, of the coils.

FIG. 8 depicts a typical three-phase Delta connection between lines L1 through L3, and FIG. 9 discloses the electrical connection of the coils in accordance with my invention. The ceramic cores carrying the three coils 76, 77 and 78 are radially oriented so that terminal 80 of coil 76 and terminal 81 of coil 78 are aligned for electrical engagement with terminal pin 82. The opposite terminal 83 of coil 78 and one terminal 84 of coil 77 are aligned for electrical engagement with terminal pin 85. The opposite terminal 86 of coil 76 and the opposite terminal 87 of coil 77 are aligned for electrical engagement with terminal pin 88.

We claim:

1. An electric resistance heating element, comprising:

a pair of elongated dielectric bodies, each having at least three openings extending longitudinally therethrough in simularly radially spaced, parallel relation, three metallic terminal pins fitting into the openings in said dielectric bodies and at least certain pins maintaining said bodies in longitudinally aligned relation, a resistance conductor on the surface of each of said bodies, each conductor having longitudinally spaced terminals, one of the terminals of each resistance conductor being electrically connected to one pin, the opposite terminal of one resistance conductor being electrically connected to a second pin, and the opposite terminal of the other resistance conductor being electrically connected to the third pin, whereby said one pin serves as a common electrical connection for the resistance conductors on both dielectric bodies, and the second and the third pins serve as separate electrical connections to respective conductors.

2. The construction according to claim 1 wherein said resistance conductors are spirally wound about respective dielectric bodies, each having one terminal fitting into the aligned openings in which said one pin fits and in frictional engagement therewith to thereby establish electrical continuity therebetween, the other terminals of said resistance conductors fitting into respective ones of the aligned openings in which said second and third pins fit and in frictional engagement therewith to thereby establish electrical continuity therebetween.

3. The construction according to claim 1 wherein one resistance conductor possesses electrical characteristics for energization by a certain voltage impressed across said first and second pins, and said other resistance conductor possesses electrical characteristics for energization by a different voltage impressed across said first and third pins.

4. The construction according to claim 1 wherein all said pins extend outwardly from one end of said longitudinally aligned dielectric bodies, for connection to a source of electrical energy.

5. The construction according to claim 1 including an additional third dielectric body having a resistance conductor on its surface with spaced terminals, all three bodies having four openings extending longitudinally therethrough in similarly radially spaced, parallel relation, and wherein said one pin is also electrically connected to one terminal of said third body, and a fourth terminal pin within the fourth opening in said bodies and electrically connected to the opposite terminal of the coil on said third body.

6. The construction according to claim 1 wherein multiples of the two dielectric bodies are provided, the resistance conductor on each of the multiple of said bodies having opposite terminals connected to said three terminal pins in accordance with the two single bodies of claim 1.

7. The construction according to claim 5, wherein multiples of the three dielectric bodies are provided, the resistance conductor on each of the multiple of said bodies having opposite terminals connected to said four terminal pins in accordance with the three single bodies of claim 5.

8. An electric resistance heating element, comprising:

a pluraity of dielectric cores each having a plurality of openings extending longitudinally therethrough, said cores being adapted for longitudinal alignment with at least certain of their openings longitudinally aligned, a plurality of terminal pins in number not exceeding the number of openings in each of said cores, at least certain of said pins fitting within the aligned openings to hold said cores in longitudinal alignment, and a resistance wire coil wound on each core, one end of each coil being disposed within a common one of the aligned openings for electrical engagement with the terminal pin fitting therein, and the other end of respective coils being disposed each in a different one of the openings for electrical engagement with respective terminal pins within said different opening.

9. An electric resistance heating element comprising:

a pluraity of dielectric cores, each having a plurality of openings extending longitudinally therethrough, said cores being adapted for longitudinal alignment with their openings longitudinally aligned, a resistance coil wound on each core, having one end inserted within one core opening at one end of the core and an opposite end inserted within another core opening at the opposite end of the core, a plurality of terminal pins in number not exceeding the number of openings in each of said cores, said pins fitting within the longitudinally aligned openings of the longitudinally aligned cores and the openings therein being radially oriented so that one terminal pin is in electrical engagement with each of said one coil end, and so that a different terminal pin is in electrical engagement with a respective one of said opposite coil ends.

10. An electric heating element, comprising:

three dielectric cores, each having a plurality of longitudinal openings, said cores being adapted for longitudinal alignment with their openings axially aligned, a resistance coil wound on each core, having one end inserted within one core opening at one end of its core and an opposite end inserted with another core opening at the opposite end, and a plurality of terminal pins, inserted within selected core openings, said cores being longitudinally aligned with their openings being radially oriented to provide predetermined engagement between coil ends and terminal pins for a three phase connection.

11. The construction according to claim 10 wherein one terminal pin electrically engages one end of each of two coils, another terminal pin, electrically engages the opposite end of one of said two coils and one end of the third coil, and a third terminal pin electrically engages the opposite end of the other of said two coils and the opposite end of said third coil, to form a three-phase Delta connection.

12. The construction according to claim 10 wherein each of said cores has four longitudinal openings for the reception of four terminal pins, one terminal pin being in electrical engagement with one end of each of the three resistance coils, and second, third and fourth terminal pins in electrical engagement with only the respective ones of the other ends of said coils, to provide a three-phase Y connection, said one terminal pin providing a common electrical connection between all three coils and said second, third and fourth terminal pins being connectable to a three-phase power system.

* * * * *